United States Patent [19]

Avasthi

[11] Patent Number: 4,977,961

[45] Date of Patent: Dec. 18, 1990

[54] METHOD TO CREATE PARALLEL VERTICAL FRACTURES IN INCLINED WELLBORES

[75] Inventor: Jitendra M. Avasthi, Brea, Calif.

[73] Assignee: Chevron Research Company, San Francisco, Calif.

[21] Appl. No.: 394,610

[22] Filed: Aug. 16, 1989

[51] Int. Cl.[5] ..... E21B 43/26

[52] U.S. Cl. ..... 166/297; 166/50; 166/308

[58] Field of Search ..... 166/50, 259, 271, 297, 166/298, 308

[56] References Cited

U.S. PATENT DOCUMENTS

| | | | |
|---|---|---|---|
| 3,835,928 | 9/1974 | Strubhar et al. | 166/308 |
| 3,878,884 | 4/1975 | Raleigh | 166/308 X |
| 4,669,546 | 6/1987 | Jennings, Jr. et al. | 166/50 X |
| 4,687,061 | 8/1987 | Uhri | 166/308 |
| 4,850,431 | 7/1989 | Austin et al. | 166/308 |

OTHER PUBLICATIONS

Economides, M. J. et al., "Performance and Stimulation of Horizontal Wells", *World Oil,* Jun. 1989, pp. 41–45.

SPE Paper 18982, "Limited Communication Between Hydraulic Fracture and (Deviated) Wellbore", Veeken et al., Mar. 6, 1989.

SPE Paper 18542, "On Fracturing Horizontal Wells", M. Y. Soliman, Nov. 1, 1988.

*Primary Examiner*—George A. Suchfield

*Attorney, Agent, or Firm*—Edward J. Keeling; Robert D. Touslee

[57] ABSTRACT

A technique is disclosed for creating parallel vertical fractures from a horizontal or inclined wellbore. Magnitude and orientation of in situ stresses within the formation are determined, and a wellbore is drilled in the direction of the minimum horizontal in situ stress. The wellbore casing is then perforated in the vertical plane by selectively placing a pair of opposing perforations within the casing. Vertical fractures are then initiated and propagated in the plane perpendicular to the minimum horizontal in situ stress by applying hydraulic pressure to fluid in the wellbore casing.

4 Claims, 2 Drawing Sheets

METHOD TO CREATE PARALLEL VERTICAL FRACTURES IN INCLINED WELLBORES

BACKGROUND OF THE INTENTION

This invention relates to the hydraulic fracturing of a subterranean earth formation and more particularly to a method of creating vertical fractures from a horizontal or inclined wellbore.

Hydraulic fracturing techniques have been extensively used for treatment and stimulation of hydrocarbon-bearing formations. Fracturing generally takes place after the interval to be produced is completed and fluid communication between the wellbore and the reservoir is established. Also, wells are sometimes stimulated by fracturing following production decline or significant depletion in a reservoir. In general, communication is established between the wellbore and the subterranean formation, through the casing, by perforations or slots in the casing. Hydraulic fracturing fluid is pumped from surface equipment into the wellbore and through the perforations or slots into the formation zone to be treated or stimulated. Sufficient amount of hydraulic fluid is forced down the wellbore to cause the parting or fracturing of the formation. Fluid flow into the fracture is continued to cause the initiated fracture to propagate further into the formation. Generally, it has been believed that at shallower formation depths the fractures are horizontal relative to the surface when the fluid pressure applied is greater than the overburden pressure in the formation. In deeper formations, when the fluid pressure is sufficiently great enough to cause the formation to fracture the fractures are generally vertical;

The mixing of proppant material with the hydraulic fracturing fluid is widely practiced to maintain the fracture open and allow hydrocarbon fluids within the formation to flow toward the wellbore for production following treatment. Ultimately, fluid communication between the formation and the wellbore through the fracture is governed both by the orientation of the wellbore, and by the in situ stresses present in the formation area of interest. In situ stresses are shown in FIG. 1, and by convention the maximum in situ stress is labeled $\sigma_1$, and at depth is the vertical overburden stress. The intermediate $\sigma_2$, and minimum, $\sigma_3$, stresses would then be oriented in a plane which is perpendicular to the vertical maximum stress plane. Both near wellbore stresses and stresses at a distance from the wellbore, along with fractures naturally existing in the formation will determine and govern the direction of initiation and propagation of fractures during a treatment.

The goal of fracture treatments is the opening and continued exposure of formation faces allowing for increased flow of fluids toward the wellbore in a formation of relatively low permeability. However, prior to the present invention, it was assumed that regardless of the orientation of perforations in the wellbore casing, when hydraulic fracture fluid was pumped into the formation through the perforations, a fracture would initiate in the plane perpendicular to the plane of minimum principal stress. U.S. Pat. No. 3,878,884 to Raleigh is one such patent where the ultimate vertical orientation of fractures is accounted for, but the near well-bore effects and placement of casing perforations are not recognized.

The direction of fracture initiation is not necessarily the direction of ultimate fracture propagation. The fracture growth and orientation are governed by the combined forces of the principal formation stresses prevalent near the wellbore and the fluid dynamics of the pumped hydraulic fluid as it enters the formation. At a distance from the wellbore, formation stresses become controlling, and the fracture will propagate from that point, reorienting if necessary, in a direction perpendicular to the minimum principal in situ stress. FIG. 2 represents the process of fracture reorientation. It is therefore quite possible the induced hydraulic fractures are not planar. Moreover, a reorientation of induced fractures may cause the fracture width to vary, causing initial bridging of proppant material and restricted, ultimate, propped width. With the advent and popularity of horizontal drilling and completions of horizontal or inclined wellbores, patterns of vertical, including multiple vertical fractures have developed. U.S. Pat. No. 4,669,546 to Jennings et al. describes a method of fracturing by placing a single perforation on the low side of a horizontal wellbore to form a single vertical fracture, rather than multiple vertical fractures. U.S. Pat. No. 4,687,061 to Uhri describes a method for creating a first and a second non-parallel fracture from a deviated wellbore.

A method is therefore desired of creating multiple parallel vertical fractures from a horizontal or inclined wellbore which avoids reorientation and associated fracture restriction.

SUMMARY OF THE INVENTION

This invention is directed to a method of creating parallel fractures from a horizontal or inclined wellbore having a casing penetrating a subterranean formation. The magnitude and orientation of the principal in situ stresses which exist in the formation in the area proposed for the wellbore are determined. A wellbore is drilled in the general direction of the determined minimum horizontal in situ stress. The casing is perforated in the vertical plane of maximum horizontal stress with a pair of perforations selectively placed at opposing points within the casing circumference wherein the perforations are phased at 0° and 180°, where 0° is the uppermost point and 180° is the bottommost point in the wellbore circumference in the vertical plane. Hydraulic pressure is applied to the cased wellbore sufficient to initiate and propagate the fractures into the formation in the plane perpendicular to the minimum horizontal in situ stress.

It is therefore an object of this invention to control the initiation, and propagation of a vertical fracture in a horizontal or inclined well.

It is another object of this invention to minimize the reorientation of a fracture plane, thereby maximizing proppant placement, fracture length and fluid flow.

It is still yet a further object of this invention to create an improved production system for draining a subterranean hydrocarbon containing formation following hydraulic fracturing.

DESCRIPTION OF THE PREFERRED EMBODIMENTS

In accordance with the present invention, there is provided a method of creating vertical fractures from a horizontal or inclined wellbore traversing a subterranean hydrocarbon-bearing formation.

Figure 1:
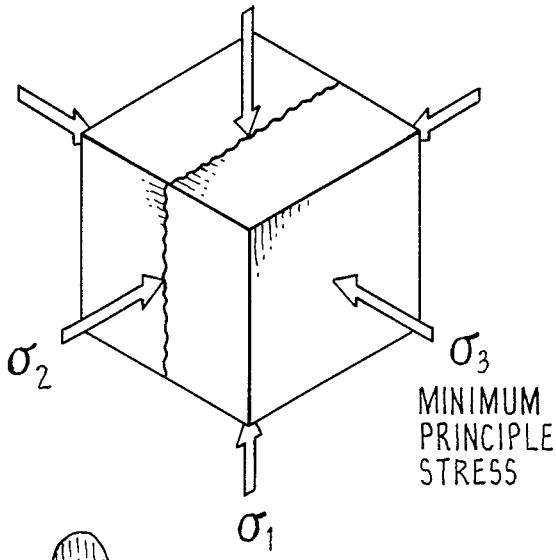
FIG. 1 is a diagrammatic representation of the three principal stresses acting upon a section of subterranean reservoir, showing a fracture perpendicular to the minimum principal stress.
Figure 2:
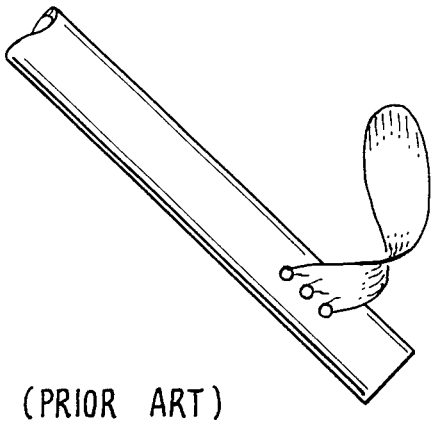
(PRIOR ART) FIG. 2.
FIG. 2 depicts the resulting tortuous fracture path resulting from perforations not selectively placed in accordance with this invention.
Figure 3:
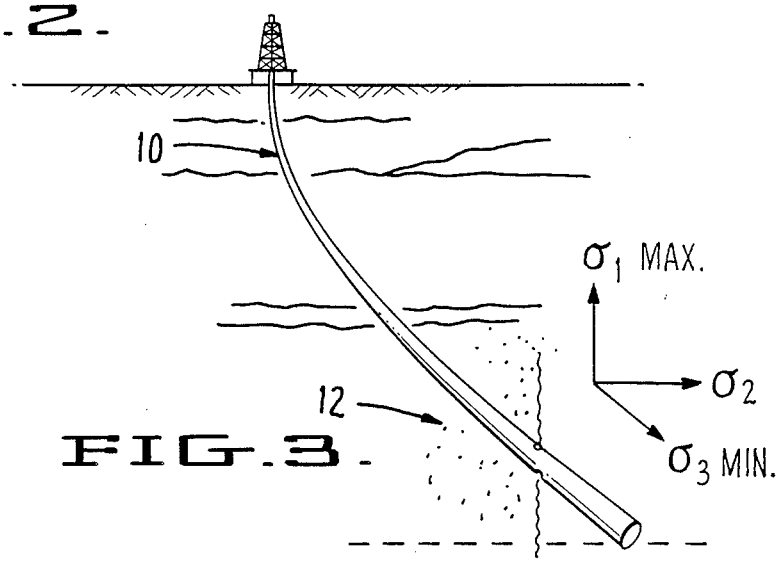
FIG. 3 shows a wellbore drilled from the surface which traverses a reservoir zone of interest, and which has a pair of opposing fractures selectively placed in the plane perpendicular to the minimum horizontal stress, and fractures initiating and propagating in the plane perpendicular to the minimum horizontal stress.
Figure 4:
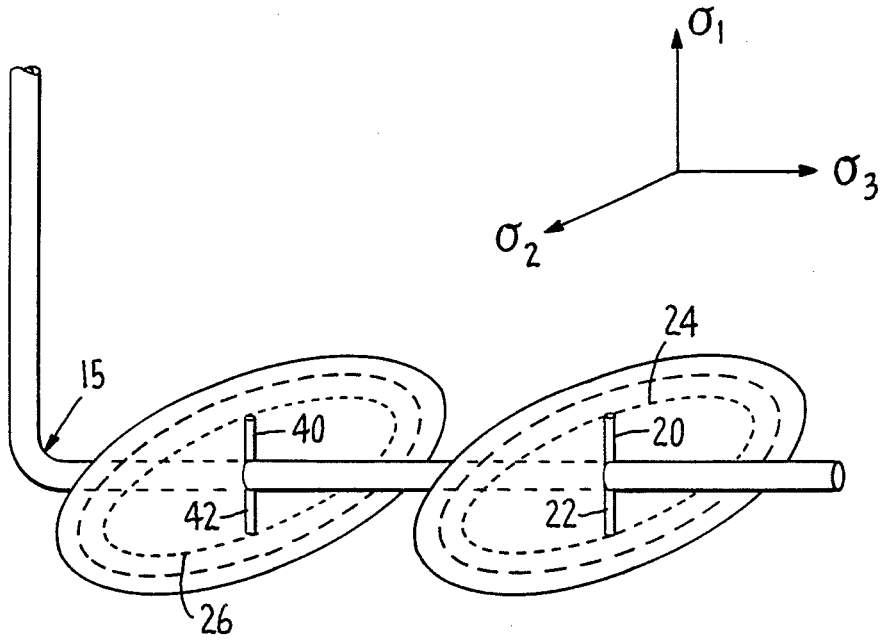
FIG. 4 depicts the method of the present invention in a horizontal well embodiment.

Referring to FIG. 3, there is shown a wellbore 10 extending from the earth's surface and penetrating at least one hydrocarbon-bearing formation 12. Wellbore 10 is provided with a casing 15. In orienting the wellbore 10 with respect to the earth's surface and within the formation 12 of interest, it is first desirable to determine the magnitude and direction of the principal in situ stresses existing within the formation 12 of interest. Among the several methods of determining principal in situ stresses which are known to those skilled in the art, the technique known as strain relaxation of the type explained by El Rabaa, A. W. N., and Meadows, D. L.: "Laboratory and Field Application of the Strain Relaxation Method", SPE Paper 195072, SPE 56th, California Regional Meeting, Apr. 2–4, 1986, Oakland, Calif., may be used to estimate both orientation and magnitude of principal in situ stresses. Another useful technique is termed "microfracturing", and is described by Daneshy et al.: "In Situ Stress Measurements During Drilling", *Journal of Petroleum Technology*, August, 1986, vol. 38, No. 9, pp. 861–897. Following the determination of in situ principal stresses, a perforating device such as Schlumberger's Enerjet Gun or the like may be used to form perforations selectively located in accordance with the present invention. Referring now to FIG. 4 for a horizontal well, perforations 20 and 22 are selectively formed at opposing sides within the wellbore casing 15 in the plane of maximum horizontal stress as previously determined. The perforations 20 and 22 are the means through which an initial fracture 24 is induced in the hydrocarbon-bearing formation of interest. Hydraulic pressuring will enlarge the initial fracture 24 within the plane perpendicular to the minimum horizontal in situ stress.

Figure 5:
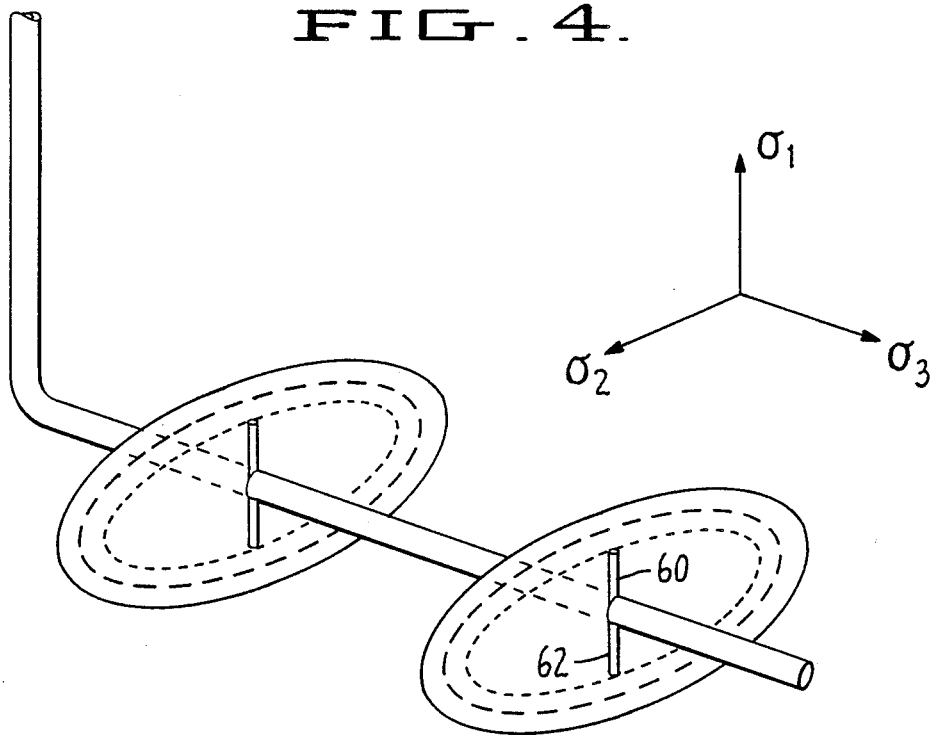
FIG. 5 depicts the method of the present invention in an inclined wellbore.

It is not necessary, in the practice of the present invention, that wellbore 10 be horizontal. The wellbore may be deviated only to a sufficient degree from the vertical to allow the opposing perforations 20 and 22 to be selectively placed in the plane which is coincident with the plane of maximum horizontal in situ stress. Since the vertical perforations will be exposed to the hydrocarbon-bearing formation, they will act as the vertical wellbore in the formation, in which the vertical induced fracture is created. The perforated interval is then hydraulically pressurized by fluid pumped from the surface, and the initially induced fracture will propagate in a direction away from the wellbore in the plane of maximum horizontal stress. The fractures may then be propped open by utilizing a suitable proppant and propping methods well known. The method of selectively placing opposing pairs of perforations in the plane of maximum horizontal stress may be practiced in a repetitive form at predetermined intervals along a single wellbore to create multiple vertical fractures which are substantially parallel to one another. In FIG. 4, a second pair of perforations 40 and 42 are selectively placed at a distance from perforations 20 and 22 utilizing the same 180° phasing. The second pair of perforations 40 and 42 may be hydraulically pressurized with fluid either simultaneously with, or after being plugged off from the first set 20 and 22, to form an initial fracture 26 at the second location within the wellbore casing 15. Successive pairs may be hydraulically fractured in simultaneous or separate fashion. A similar orientation may be employed for the inclined wellbore shown in FIG. 5. In the case of an inclined wellbore, a perforation pair 60 and 62 is selectively placed within the plane of maximum horizontal stress, by a perforating device oriented to direct perforations in the vertical direction, which is also the direction of maximum principal in situ stress. Application of hydraulic pressure to the wellbore casing causes the initial fracture 70 to propagate in a direction perpendicular to the minimum horizontal in situ stress. It is therefore, not necessary the wellbore be exactly perpendicular to the direction of maximum principal stress, because the perforating device may be directed. The foregoing described method of the present invention provides for effective fracturing of a horizontal or inclined wellbore where the magnitude and orientation of principal in situ stresses are known or may be estimated. Such method provides for fractures which do not tend to reorient at a distance from the wellbore and thus possess, among others, the sought quality of resistance to proppant bridging and thus provide a better path for formation-contained hydrocarbons to flow to the wellbore for production to the surface.

Although the present invention has been described with preferred embodiments, it is to be understood that modifications and variations may be resorted to without departing from the spirit and scope of the present invention, as those skilled in the art will readily understand. Such modifications and variations are considered to be within the purview and scope of the appended claims.

What is claimed is:

1. A method for creating parallel fractures from a horizontal or inclined wellbore having a casing penetrating a subterranean formation, comprising the steps of:

(a) determining the magnitude and orientation of the principal in situ stresses which exist in the formation in the area proposed for the wellbore;

(b) drilling and casing a wellbore in the general direction of the determined minimum horizontal in situ stress;

(c) perforating the casing in the vertical plane of maximum horizontal stress with a pair of perforations selectively placed at opposing points within the casing circumference wherein the perforations are phased at 0° and 180°, where 0° is the uppermost point and 180° is the bottommost point on the wellbore circumference in the vertical plane;

(d) applying hydraulic pressure to the cased wellbore sufficient to initiate and propagate the fractures into the formation in the plane perpendicular to the minimum horizontal in situ stress.

2. The method of claim 1 wherein the wellbore is deviated relative to the vertical direction.

3. A method of recovering hydrocarbons from a subterranean formation comprising the steps of:

(a) determining the magnitude and orientation of principal in situ stresses in the subterranean formation;

(b) drilling and casing a wellbore in the direction of the determined minimum horizontal in situ stress;

(c) perforating the casing at a first perforation point in the vertical plane of maximum horizontal stress with a pair of perforations selectively located at opposing points within the casing circumference wherein the perforations are phased at 0° and 180°, where 0° is the uppermost point and 180° is the bottommost point on the wellbore circumference in the vertical plane;

(d) perforating the casing at a second perforation point in the plane of maximum horizontal stress with a second pair of perforations selectively placed at opposing points within the casing circumference wherein the second perforations are phased at 0° and 180°, where 0° is the uppermost point and 180° is the bottommost point on the wellbore circumference in the vertical plane;

(e) applying hydraulic pressure to the cased wellbore sufficient to propagate the fractures at the first and second perforation point into the formation in the plane perpendicular to the minimum horizontal in situ stress; and (f) producing to the surface formation fluids which enter the wellbore through at least the first and second perforations in the wellbore casing.

4. A hydraulic fracturing technique to create multiple fractures from a wellbore which traverses a subterranean formation comprising the steps of:

(a) determining the magnitude and orientation of principal in situ stresses in the subterranean formation;

(b) drilling and casing a wellbore in the direction of the determined minimum horizontal in situ stress;

(c) perforating the casing at a first perforation point in the vertical plane of maximum horizontal stress with a pair of perforations selectively located at opposing points within the casing circumference wherein the perforations are phased at 0° and 180°, where 0° is the uppermost point and 180° is the bottommost point on the wellbore circumference in the vertical plane;

(d) applying hydraulic pressure to the cased wellbore sufficient to initiate and propagate fractures into the formation in the plane perpendicular to the minimum horizontal in situ stress;

(e) isolating the first pair of perforations from fluid communication with the second pair of perforations, and;

(f) perforating the casing at a second perforation point in the plane of maximum horizontal stress with a second pair of perforations selectively placed at opposing points within the casing circumference wherein the second perforations are phased at 0° and 180°, where 0° is the uppermost point and 180° is the bottommost point on the wellbore circumference in the vertical plane;

(g) applying hydraulic pressure to the cased wellbore sufficient to initiate and propagate the second pair of perforations into the formation in the plane perpendicular to the minimum horizontal in situ stress.

* * * * *